US006443255B1

(12) United States Patent
Shavender, Jr.

(10) Patent No.: US 6,443,255 B1
(45) Date of Patent: Sep. 3, 2002

(54) MARINE MUFFLER

(75) Inventor: Richard William Shavender, Jr., Washington, NC (US)

(73) Assignee: Fountain Powerboats, Inc., Washington, NC (US)

( * ) Notice: Subject to any disclaimer, the term of this patent is extended or adjusted under 35 U.S.C. 154(b) by 0 days.

(21) Appl. No.: 09/732,950

(22) Filed: Dec. 8, 2000

(51) Int. Cl.[7] ..... F01N 1/02

(52) U.S. Cl. ..... 181/250; 181/255; 181/265; 181/269

(58) Field of Search ..... 181/233, 235, 181/250, 251, 255, 265, 269, 272, 275, 276, 282

(56) References Cited

U.S. PATENT DOCUMENTS

| | | | | | |
|---|---|---|---|---|---|
| 2,189,425 | A | * | 2/1940 | Leadbetter | 181/265 |
| 2,520,756 | A | | 8/1950 | Bryant | |
| 3,209,862 | A | | 10/1965 | Young | |
| 3,507,357 | A | | 4/1970 | Blome | |
| 4,192,401 | A | * | 3/1980 | Deaver et al. | 181/272 |
| 4,360,076 | A | * | 11/1982 | Suyama | 181/265 |
| 4,905,791 | A | | 3/1990 | Garey | |
| 4,941,545 | A | | 7/1990 | Wilcox et al. | |
| 5,043,147 | A | | 8/1991 | Knight | |
| 5,147,987 | A | | 9/1992 | Richardson et al. | |
| 5,187,334 | A | | 2/1993 | Abbott et al. | |
| 5,262,600 | A | | 11/1993 | Woods | |
| 5,367,131 | A | | 11/1994 | Bemel | |
| 5,625,173 | A | | 4/1997 | Woods | |
| 5,949,035 | A | | 9/1999 | Herold | |
| 5,969,300 | A | | 10/1999 | Ford | |

* cited by examiner

*Primary Examiner*—Khanh Dang
(74) *Attorney, Agent, or Firm*—MacCord Mason PLLC

(57) ABSTRACT

A muffler for use with high performance powerboats to reduce exhaust noise to below 90 decibels without significantly reducing horsepower is described. The muffler includes a cylindrical outer housing with an interior cavity that is divided into first and second chambers by parallel intake and discharge cylinders. The intake cylinder has intake and discharge ends, and inwardly directed louvers toward the intake cylinder discharge end. The abutting discharge cylinder has inner and discharge ends, with inwardly directed louvers toward the discharge cylinder inner end. A first plate extends across the interior cavity of the housing, blocking the inner end of the discharge cylinder, with the intake end of the intake cylinder extending through a hole in the first plate. A second plate extends across the interior cavity of the housing, and includes a hole in communication with the discharge end of the discharge cylinder. The discharge end of the intake cylinder is spaced from the second plate, so that exhaust gas entering the intake cylinder is discharged through the intake cylinder louvers and discharge end into the interior chambers, and then into the discharge cylinder through the discharge cylinder louvers, and from the discharge end of the discharge cylinder.

20 Claims, 3 Drawing Sheets

MARINE MUFFLER

BACKGROUND OF THE INVENTION (1) Field of the Invention

The present invention relates generally to a sound attenuating muffler or exhaust silencer for use as part of an exhaust system for inboard marine engines, and in particular to a marine muffler to be used in the exhaust system of high-performance powerboats to reduce exhaust sound levels to acceptable decibel levels without significantly reducing performance.

(2) Description of the Prior Art

The majority of states have now set maximum levels for motorboat noise, and similar regulations are likely in additional states. State regulations are not uniform. Tennessee and Colorado, for example, require a maximum noise level of 86 decibels at 50 feet or more. Ohio limits noise levels to 90 decibels when subjected to a stationary, on-site sound level test, or 75 decibels when subjected to a shoreline test. Vermont requires a noise level to not more than 82 decibels at 50 feet in a normal operating environment. Georgia requires a noise level that does not exceed 84 decibels measured at a distance of 50 feet. The National Marine Manufacturers Association recommends a maximum of 75 and 90 decibels, depending on whether the boat is moving or stationary, while The National Association of State Boating Law Administrators recommends an 88-decibel maximum.

Reduction of exhaust noise levels to 90 decibels or less has heretofore required a significant reduction in horsepower and performance, particularly when muffling the exhaust noise of high horsepower, high-performance powerboats, which can reach top speeds in excess of 80 mph. Since these boats are designed for speed, a significant reduction in horsepower, and resultant top speed, is highly undesirable.

Therefore, an exhaust silencer or muffler that could reduce the exhaust sound levels of high performance inboard powerboats to 90 decibels or less without significantly sacrificing horsepower and speed would be of considerable value in meeting noise regulations without sacrificing the enjoyment of boaters.

SUMMARY OF THE INVENTION

The present invention relates to a muffler meeting these requirements. These mufflers are adapted to be attached to the end of the exhaust pipe that extends rearwardly from the boat engine. Normally, the muffler will be attached at the exterior of the boat transom beneath the swim platform. In the following description, the muffler and its components will be described as having an intake or inner end, meaning the end that is toward the boat engine and exhaust pipe when the muffler is mounted on the boat, and the discharge or outer end, meaning the end opposite the intake or inner end, and away from the engine and exhaust pipe. While the invention will be described in terms of one muffler, it will be appreciated that a boat may also have two or more exhaust pipes with a muffler mounted at the end of each pipe.

Generally, the present muffler is comprised of a cylindrical outer housing that has an intake end adapted to be attached directly or indirectly to the discharge end of an exhaust pipe and a discharge end on the opposite end of the cylindrical housing. The housing encloses a pair of adjacent parallel interior cylinders, i.e., a first or intake cylinder that has an inlet end that communicates through the intake end of the outer housing with the exhaust pipe, and a second or discharge cylinder that communicates through the discharge end of the outer housing to the exterior of the muffler.

The outer housing and the intake and discharge cylinders are sized such that the inner diameter of the outer housing is substantially equal to the combined external diameters of the interior cylinders. Therefore, when the two interior cylinders are positioned in an abutting and parallel relationship, the interior cylinders will snugly fit into the interior of the outer housing, with the interior cylinders abutting the interior wall of the outer housing. As a result, the two interior cylinders effectively divide the interior of the outer housing into first and second interior chambers that are on opposite sides of the interior cylinders.

Exhaust gas entering the intake cylinder is discharged into the first and second interior chambers through openings or perforations in the wall of the intake cylinder and through the cylinder discharge end. Continuing discharge of exhaust gas forces the exhaust gas from the interior chambers and into the second or discharge interior cylinder through openings in the wall of the discharge cylinder, and then from the muffler through the discharge end of the discharge cylinder.

In a preferred embodiment, the cylindrical outer housing is capped at its intake end with a transverse annular end plate that extends across the end of the cylinder. A connector pipe is joined to the intake plate around the periphery of the central opening, and extends away from the muffler in the intake direction for connection directly or indirectly to the exhaust pipe of the boat's exhaust system.

The longitudinal axis of the connector pipe can be parallel to the longitudinal axis of the muffler, or all or a part of the pipe can be at an angle, depending upon the configuration of the boat's exhaust system and the placement of the muffler. Preferably, at least part of the muffler will be mounted in a generally horizontal alignment on the outer side of the transom with the connector pipe being angled upwardly. As a result, any water entering the muffler will not enter the exhaust system.

The discharge end of the outer housing is preferably covered with a perforated screen, which may be in the form of a perforated plate or a woven screen, which will not interfere with the discharge of exhaust gas, but which will largely prevent debris and other objects from entering the muffler. The screen may be held in place with an annular ring secured to the end of the housing.

The muffler also includes first and second interior baffle plates that extend transversely across the interior of the housing. The first or intake end baffle plate is spaced from the discharge side of the intake end plate to form an entrance chamber. This entrance chamber provides some sound attenuation, and also serves as an adapter to join the connector pipe, which will normally be of the same diameter as the exhaust pipe, and equal to or slightly less in diameter than the outer housing, to the smaller diameter intake cylinder. The intake end of the intake cylinder communicates with the entrance chamber through a hole or opening in the first baffle plate. The first baffle plate also caps the inner end of the discharge cylinder.

Similarly, a second or exhaust end baffle plate extends across the interior of the housing, and is spaced toward the intake end of the muffler from the discharge screen to form an exhaust chamber. The exhaust cylinder discharge end communicates through an opening in the second baffle plate, permitting exhaust gases to be discharged into the exhaust chamber, and from there through the screen to the atmosphere.

In a preferred embodiment of the invention, the discharge end of the intake cylinder is spaced from the interior side of the second baffle plate, so that exhaust gases can be discharged from the intake cylinder openings and from the discharge end of the intake cylinder. As exhaust gases are discharged from the discharge end of the intake cylinder, the exhaust gases impinge upon the inner face of the second baffle plate, and are redirected into the first and second interior chambers for subsequent removal through the discharge cylinder.

Sound attenuation is a function of the number and shape of surfaces contacted by the exhaust gas in the muffler and the pathways followed by the exhaust gases between the intake and discharge ends of the muffler. The configuration of the openings in the walls of the intake and discharge cylinders is believed to be particularly suited to achieving maximum sound attenuation or deadening, bringing the exhaust sound into the desired decibel range, without significantly diminishing horsepower and resultant speed.

In the preferred embodiment, each inner cylinder includes a plurality of openings in the form of inwardly directed louvers that have a base end at the wall of the cylinder and a tip end extending radially into the interior of the cylinder. Preferably, each louver is formed by cutting a circumferential slit in the cylinder wall and pressing inwardly on the wall on one side of the slit. As a result, a curved louver with a free end edge and attached base and side edges is formed.

Preferably, a plurality of bands of circumferential slits are formed around the cylinder, with each band including a plurality of slits spaced an equal distance from each other by wall areas. The wall areas, i.e., the non-slit areas, are preferably equal in length to the slits, with the slits in one band being aligned with wall areas of adjacent bands. The wall adjacent the same side of each slit is pressed radially inwardly, so that the louvers all extend in the same direction. Preferably, each band has at least three slits.

The intake cylinder is aligned so that the louvers extend away from the intake end of the intake cylinder, i.e., the inwardly extending tips of the louvers extend inwardly in the direction of the discharge end of the intake cylinder. The discharge cylinder, however, is aligned in the opposite direction. That is, the inwardly extending tips of the louvers of the exhaust cylinder extend toward the capped inner end of the exhaust cylinder.

In use, therefore, exhaust gases are discharged through the connector pipe into the intake chamber, and then into the intake cylinder. Within the intake cylinder, the exhaust gas impinges on the inner surface of each louver, and is directed inwardly toward the center of the intake cylinder. The gases are then forced out of the intake cylinder and into one of the interior chambers through the louver slits, being forced to take a U-turn, due to the louver configuration, thereby impinging on the louver outer surfaces. A portion of the exhaust gas also exits through the discharge end of the intake cylinder.

From the interior chambers, the exhaust gas is forced into the interior of the discharge cylinder, and is again forced to make a U-turn to move through the interior of the discharge cylinder. The exhaust gas is then discharged from the discharge cylinder into the exhaust chamber and then through the exhaust screen.

Accordingly, one aspect of the present invention is to provide a boat muffler comprising a housing having an intake end and a discharge end, and a continuous wall defining an interior cavity; a perforated intake cylinder within the housing, the intake cylinder having an intake end and a discharge end; a perforated discharge cylinder within the housing, the discharge cylinder having an inner end and a discharge end, the intake and discharge cylinder being in parallel alignment; a first plate extending across the interior cavity of the housing, the first plate blocking the inner end of the discharge cylinder, and including a hole in communication with the intake end of the intake cylinder; and a second plate extending across the interior cavity of the housing, the second plate including a hole in communication with the discharge end of the discharge cylinder.

Another aspect of the present invention is to provide a muffler for use with high performance powerboats to reduce exhaust noise to below 90 decibels without significantly reducing horsepower comprising a cylindrical outer housing having an intake end and a discharge end, and a continuous cylindrical wall defining an interior cavity, the interior cavity having a circular cross-section with a first given diameter; an intake cylinder within the housing, the intake cylinder having an intake end, a discharge end, a second given external diameter, and inwardly directed louvers extending toward the intake cylinder discharge end; a discharge cylinder within the housing, the discharge cylinder having an inner end and a discharge end, a third given diameter, and inwardly directed louvers extending toward the discharge cylinder inner end; the intake and discharge cylinder being in parallel alignment, the second and third given diameter being substantially equal to the first given diameter, whereby the cylinders divide the housing interior cavity into first and second interior chambers; a first plate extending across the interior cavity of the housing, the first plate blocking the inner end of the discharge cylinder, and including a hole in communication with the intake end of the intake cylinder; and a second plate extending across the interior cavity of the housing, the second plate including a hole in communication with the discharge end of the discharge cylinder.

These and other aspects of the present invention will become apparent to those skilled in the art after a reading of the following description of the preferred embodiment.

DETAILED DESCRIPTION OF THE INVENTION

Figure 1:
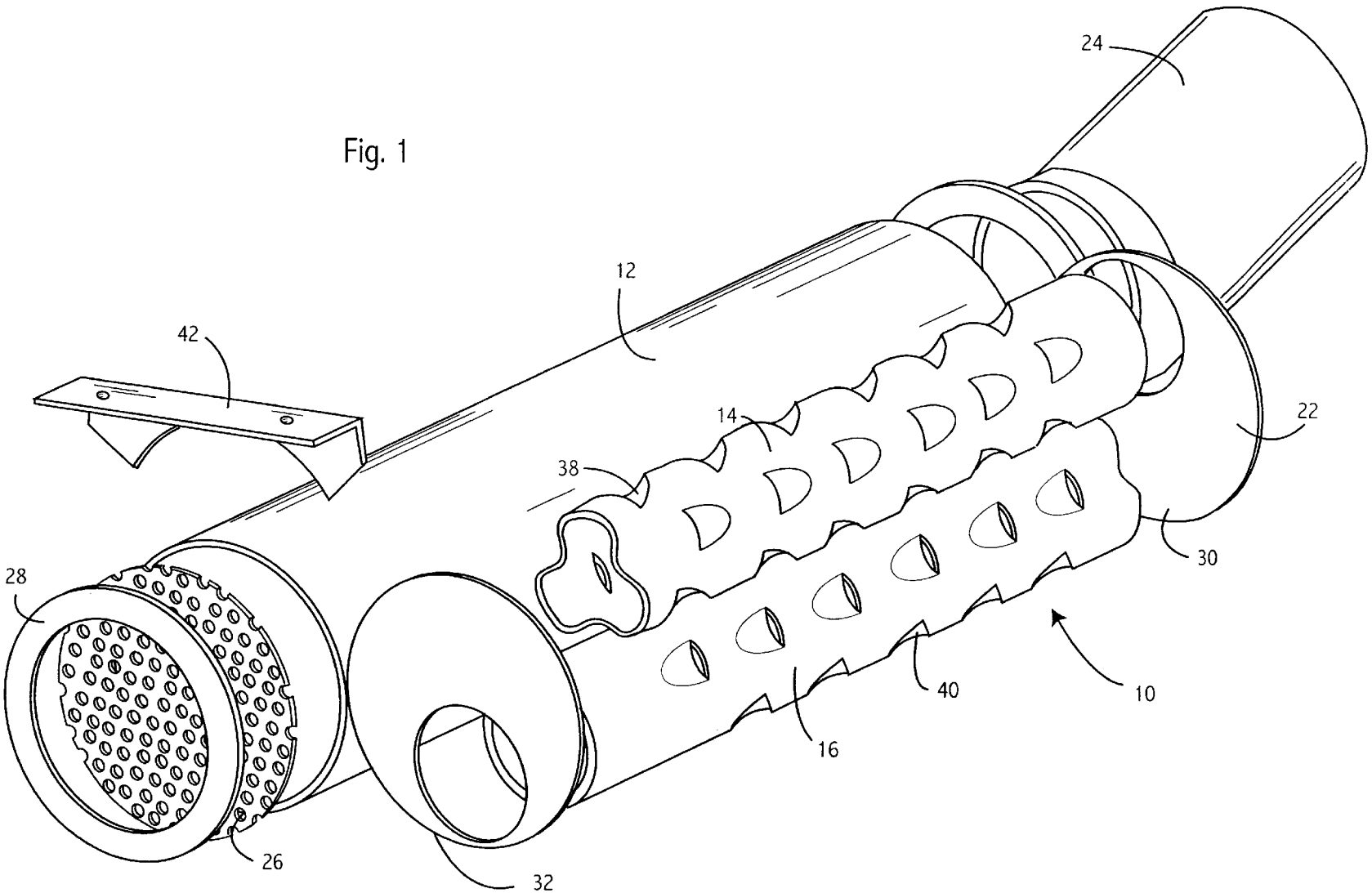
FIG. 1 is a perspective view of the muffler of the invention.
Figure 2:
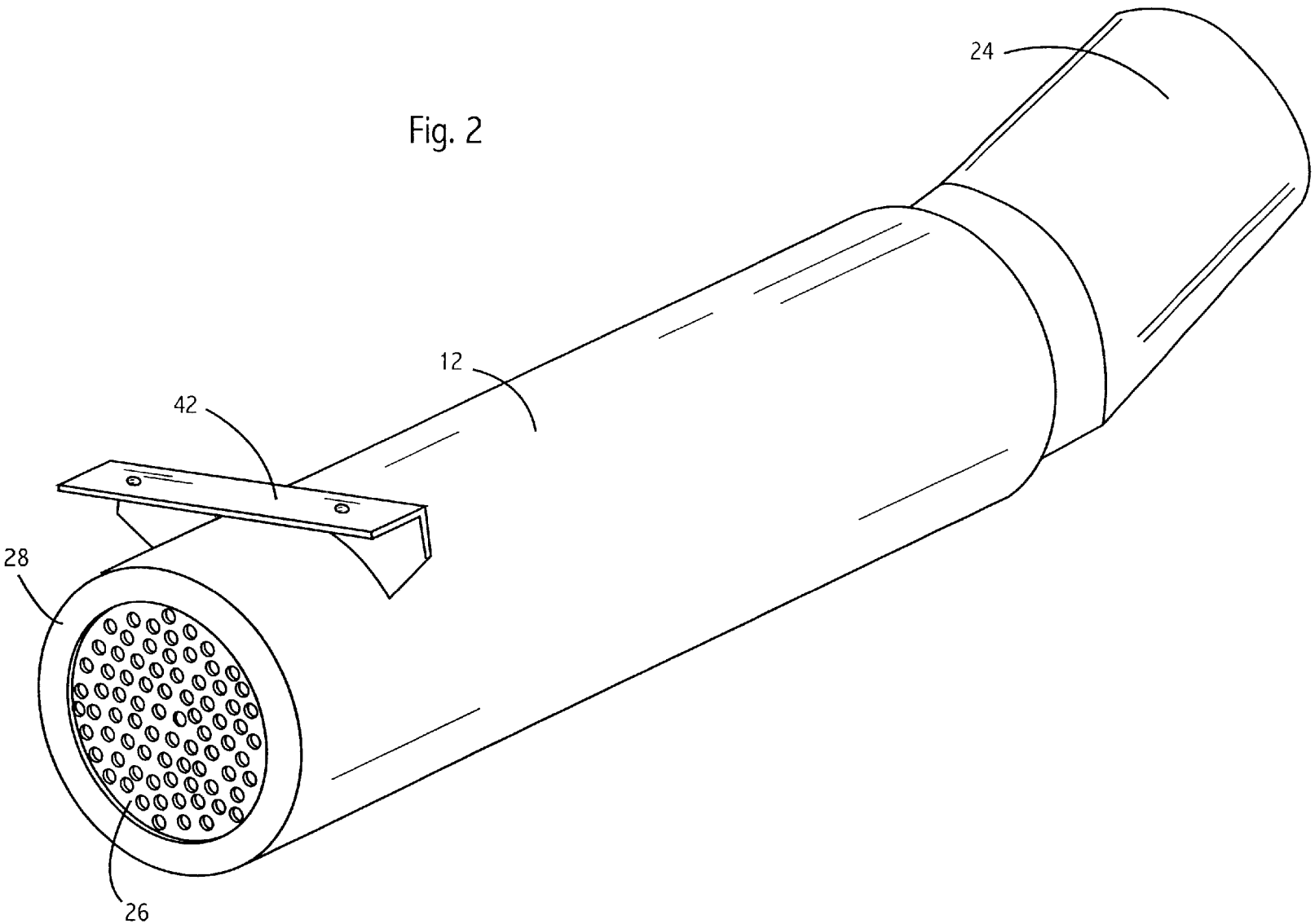
FIG. 2 is an exploded perspective view of the muffler of FIG. 1.
Figure 3:
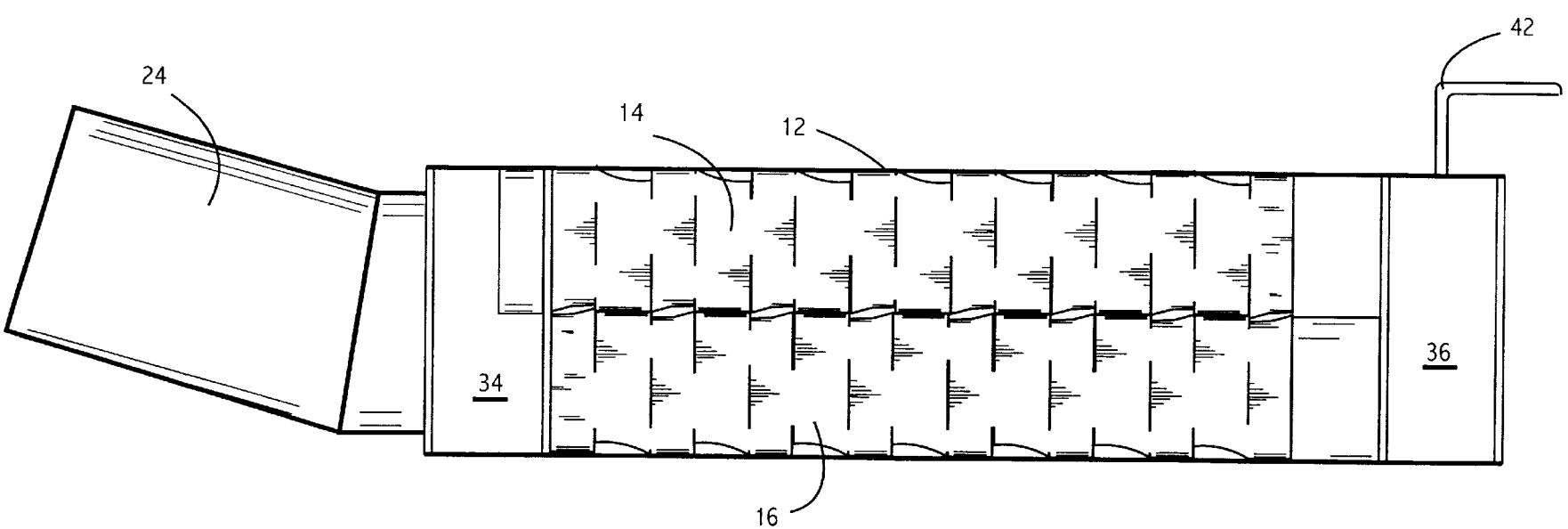
FIG. 3 is side view of the muffler of FIG. 1, with a section of the housing removed to show the interior of the muffler.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the drawings, the preferred embodiment of the muffler, generally 10, is comprised of a cylindrical outer housing 12 that encloses intake cylinder 14, and parallel, abutting discharge cylinder 16. Interior cylinders 14 and 16 are vertically stacked with their combined external diameters being substantially equal to the internal diameter of housing 12. As a result, cylinders 14 and 16 divide the interior of housing 12 into interior chambers 18 and 20.

Housing 12 is capped at its intake end with transverse intake end plate 22. Connector pipe 24 is secured to intake plate 22 around the periphery of a hole in plate 22. The opposite or discharge end of housing 12 is covered with a screen 26 that is attached to housing 12 with an annular ring 28.

First and second interior baffle plates 30 and 32, respectively, extend transversely across the interior of housing 12, and are spaced interiorly from end plate 22 and screen 26, respectively. Housing 12, end plate 22 and baffle plate 30 form an intake chamber 34, while housing 12, screen 26 and baffle plate 32 form a discharge chamber 36.

As illustrated, the discharge end of intake cylinder 14 is spaced from the interior side of baffle plate 32, permitting exhaust gases to discharge from the discharge end of intake cylinder 14. Cylinder 14 also includes a plurality of inwardly directed louvers 38 that have a base end at the wall of the cylinder 14 and a tip end extending radially into the interior of the cylinder and towards the discharge end of cylinder 14. The continuous outer wall of discharge cylinder 16 also includes a plurality of louvers 40. However, louvers 40 are inclined in the opposite direction from louvers 38. That is, the tips of louvers 40 extend toward the capped inner end of discharge cylinder 16. Muffler 10 can also include other components, such as the swim platform attachment bracket 42 shown in the drawings.

When used, exhaust gas is discharged from the boat exhaust system through connector pipe 24 into the intake chamber 34, and then into the intake cylinder 14, and impinges on the inner surface of louver 38. The exhaust gas is then forced from cylinder 14 into interior chambers 18 and 20 through louvers 40 in cylinder 16. The exhaust gas is then discharged from cylinder 16 into exhaust chamber 36 and from muffler 10 through exhaust screen 26.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A boat muffler comprising:

a) a housing having an intake end and a discharge end, and a continuous wall defining an interior cavity;

b) a perforated intake cylinder within said housing, said intake cylinder having an intake end and a discharge end;

c) a perforated discharge cylinder within said housing, said discharge cylinder having an inner end and a discharge end, said intake and discharge cylinder being in abutting, parallel alignment, said intake and discharge cylinders abutting said housing wall and dividing said housing interior cavity into first and second interior chambers;

d) a first plate extending across the interior cavity of said housing, said first plate blocking the inner end of said discharge cylinder, and including a hole in communication with the intake end of said intake cylinder; and e) a second plate extending across the interior cavity of said housing, said second plate including a hole in communication with the discharge end of said discharge cylinder.

2. The muffler of claim 1, wherein said housing is cylindrical with an internal diameter substantially equal to the combined diameters of said intake and discharge cylinders.

3. The muffler of claim 1, wherein said cylinders include inwardly directed louvers.

4. The muffler of claim 1, wherein said muffler further contains a connector pipe attached to the intake end of said housing.

5. The muffler of claim 1, wherein said first cylinder is spaced from the intake end of said housing to form an intake chamber.

6. The muffler of claim 1, further including a screen across the discharge end of said housing, said second plate being spaced from said screen to form a discharge chamber.

7. The muffler of claim 1, wherein said second plate has an interior face, the discharge end of said intake cylinder being spaced from the interior face of said second plate.

8. The muffler of claim 1, wherein the intake end of said intake cylinder extends through the hole in said first plate.

9. The muffler of claim 1, further including a mounting bracket attached to said housing.

10. The muffler of claim 1, wherein said intake cylinder includes inward louvers extending toward the discharge end of said intake cylinder, and said discharge cylinder includes inwardly directed louvers extending toward the inner end of said discharge cylinder.

11. A boat muffler comprising:

a) a housing having an intake end and a discharge end, and a continuous cylindrical wall defining an interior cavity, said interior cavity having a circular cross-section with a first given interior diameter;

b) a perforated intake cylinder within said housing, said intake cylinder having an intake end, a discharge end, and a first given external diameter;

c) a perforated discharge cylinder within said housing, said discharge cylinder having an inner end and a discharge end, and a second given external diameter, said intake and discharge cylinders being in parallel and abutting alignment, said first and second given external diameters being substantially equal to said first given internal diameter, whereby said cylinders abut said housing wall to divide said housing interior cavity into first and second interior chambers;

d) a first plate extending across the interior cavity of said housing, said first plate blocking the inner end of said discharge cylinder, and including a hole in communication with the intake end of said intake cylinder; and e) a second plate extending across the interior cavity of said housing, said second plate including a hole in communication with the discharge end of said discharge cylinder.

12. The muffler of claim 11, further including an annular end wall extending across the intake end of said housing, said annular end wall including a connector pipe opening, said first plate being space from said annular end wall; said housing, annular end wall and first plate defining an intake chamber.

13. The muffler of claim 11, wherein said intake cylinder includes inward louvers extending toward the discharge end of said intake cylinder, and said discharge cylinder includes inwardly directed louvers extending toward the inner end of said discharge cylinder.

14. The muffler of claim 12, wherein said intake cylinder extends through said first plate and into said intake chamber.

15. The muffler of claim 11, wherein the discharge end of said intake cylinder is spaced from said second plate.

16. A muffler for use with high performance powerboats to reduce exhaust noise to below 90 decibels without significantly reducing horsepower comprising:

a) a cylindrical outer housing having an intake end and a discharge end, and a continuous cylindrical wall defining an interior cavity, said interior cavity having a circular cross-section with a first given interior diameter;

b) an intake cylinder within said housing, said intake cylinder having an intake end, a discharge end, a first given external diameter, and inwardly directed louvers extending toward said intake cylinder discharge end;

c) a discharge cylinder within said housing, said discharge cylinder having an inner end and a discharge end, a second given external diameter, and inwardly directed louvers extending toward said discharge cylinder inner end, said intake and discharge cylinders being in abutting parallel alignment, said first and second given external diameters being substantially equal to said first given interior diameter, whereby said cylinders abut said housing wall to divide said housing interior cavity into first and second interior chambers;

d) a first plate extending across the interior cavity of said housing, said first plate blocking the inner end of said discharge cylinder, and including a hole in communication with the intake end of said intake cylinder; and e) a second plate extending across the interior cavity of said housing, said second plate including a hole in communication with the discharge end of said discharge cylinder.

17. The muffler of claim 16, further including an annular end wall extending across the intake end of said housing, said annular end wall including a connector pipe opening, said first plate being spaced from said annular end wall; said housing, annular end wall and first plate defining an intake chamber.

18. The muffler of claim 16, wherein said intake cylinder extends through said first plate.

19. The muffler of claim 16, wherein the discharge end of said intake cylinder is spaced from said second plate.

20. The muffler of claim 16, further including a screen extending across the discharge end of said housing, said second plate being spaced from said screen, said housing screen and second plate defining a discharge chamber.

* * * * *